US008212133B2

(12) United States Patent
Chen

(10) Patent No.: US 8,212,133 B2
(45) Date of Patent: Jul. 3, 2012

(54) DRUM PEDAL ASSEMBLY

(76) Inventor: Kuo-Chang Chen, Taichung (TW)

( * ) Notice: Subject to any disclaimer, the term of this patent is extended or adjusted under 35 U.S.C. 154(b) by 0 days.

(21) Appl. No.: 12/566,645

(22) Filed: Sep. 24, 2009

(65) Prior Publication Data

US 2011/0067552 A1 Mar. 24, 2011

(51) Int. Cl.
*G10D 13/02* (2006.01)

(52) U.S. Cl. ..... 84/422.1

(58) Field of Classification Search ..... 84/422.1
See application file for complete search history.

(56) References Cited

U.S. PATENT DOCUMENTS 3,930,431 A * 1/1976 Magadini ..... 84/422.1
4,134,325 A * 1/1979 Loftus ..... 84/422.1
4,188,853 A * 2/1980 Bills ..... 84/422.1
4,198,894 A * 4/1980 Della-Porta et al. ..... 84/422.1
4,691,613 A * 9/1987 Jacobson ..... 84/422.1
5,396,826 A * 3/1995 Lombardi ..... 84/422.1
6,188,007 B1 * 2/2001 Liao ..... 84/422.3
6,359,205 B1 * 3/2002 Lombardi ..... 84/422.1
6,822,150 B1 * 11/2004 Lombardi ..... 84/422.3
7,629,525 B1 * 12/2009 Lin ..... 84/422.1
2008/0196574 A1 * 8/2008 Kjellgren ..... 84/422.1

* cited by examiner

*Primary Examiner* — Elivin G Enad
*Assistant Examiner* — Christopher Uhlir

(57) ABSTRACT

A drum pedal assembly includes a frame, multiple bearings, an axle, a drum hammer, a base plate, an extender, a pedal and a transmission element. The frame includes two parallel upright supportive racks and a base. An end of the base plate is pivoted vertically with respect to the base, and the base plate also has a sliding groove disposed along its lengthy direction. The sliding groove has an open end away from the base. The extender is plate-shaped and is slidably inserted in the sliding groove. The pedal has a first end and a second end. The first end pivots to a distal end of the extender by a pivot means. The transmission element is disposed between the second end of the pedal and the axle. The axle and the drum hammer are driven to rotate by the transmission element to rotate as the second end of the pedal pivots.

9 Claims, 9 Drawing Sheets

DRUM PEDAL ASSEMBLY

BACKGROUND OF THE INVENTION

1. Field of the Invention

The present invention relates to a percussion instrument pedal assembly, and more particularly to a collapsible drum pedal assembly.

2. Description of the Prior Art

A percussion instrument can be percussed by a pedal assembly. That is, the instrument player can tread on a pedal of the pedal assembly to percuss the percussion instrument. For storage purpose, some conventional pedal assembly is designed to be collapsible.

As disclosed in TW M267585, two pivoting elements are parallel pivoted to a supportive frame. Distal ends of the pivoting elements are pivoted to one end of a pedal, thus the pedal is collapsible.

Further, as disclosed in U.S. Pat. No. 7,511,212, it provides two L-shaped side frames pivoted to the main stand body. Each side frame has a guide slot (212A) and a rail (212B) and is slidable along the rail by a locking element (26) passing through the guide slot and a hole thereof.

SUMMARY OF THE INVENTION

The main object of the present invention is to provide a collapsible drum pedal assembly.

Another main object of the present invention is to provide a drum pedal assembly in which an elevation of a drum hammer thereof is still adjustable as the drum pedal assembly is collapsed.

To achieve the above and other objects, a drum pedal assembly of the present invention includes a frame, multiple bearings, an axle, a drum hammer, a base plate, an extender, a pedal and a transmission element. The frame includes two parallel upright supportive racks and a base, and the base connects bottoms of the supportive racks.

The bearings are coaxially disposed on the frame, and the axle is supported by at least two of the bearings. The drum hammer is disposed on the axle in a rotational operative relationship. The base plate is pivoted vertically with respect to the base at one end thereof. A sliding groove is formed on the base plate along a length direction of the base plate, and the sliding groove has an open end away from the base. The extender is plate-shaped and slidably inserted in the sliding groove, and the extender has a distal end away from the base. The pedal has a first end and a second end, and the first end pivots to the distal end of the extender by a pivot means. The transmission element is disposed between the second end of the pedal and the axle. The axle and the drum hammer are driven by the transmission element to rotate as the second end of the pedal pivots.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
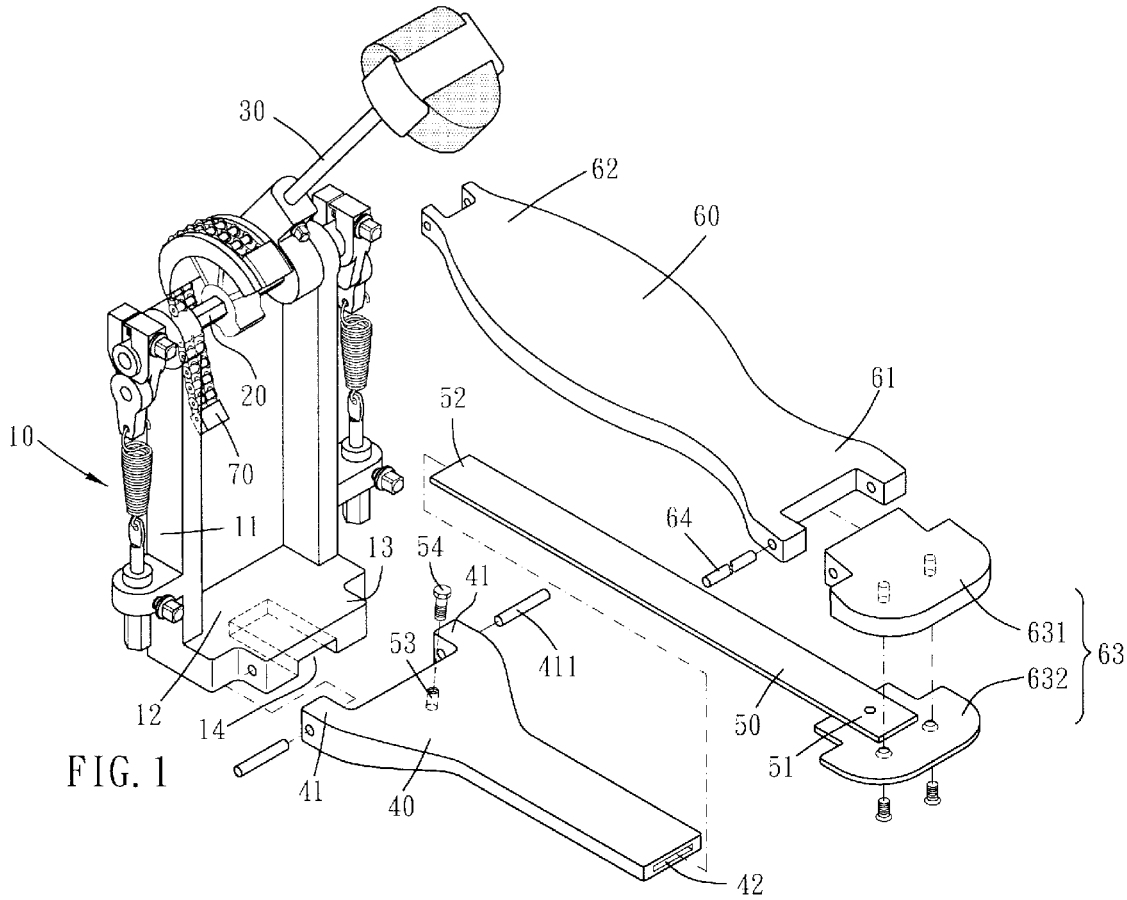
FIG. 1 is a breakdown drawing showing a first preferred embodiment of the present invention.
Figure 2:
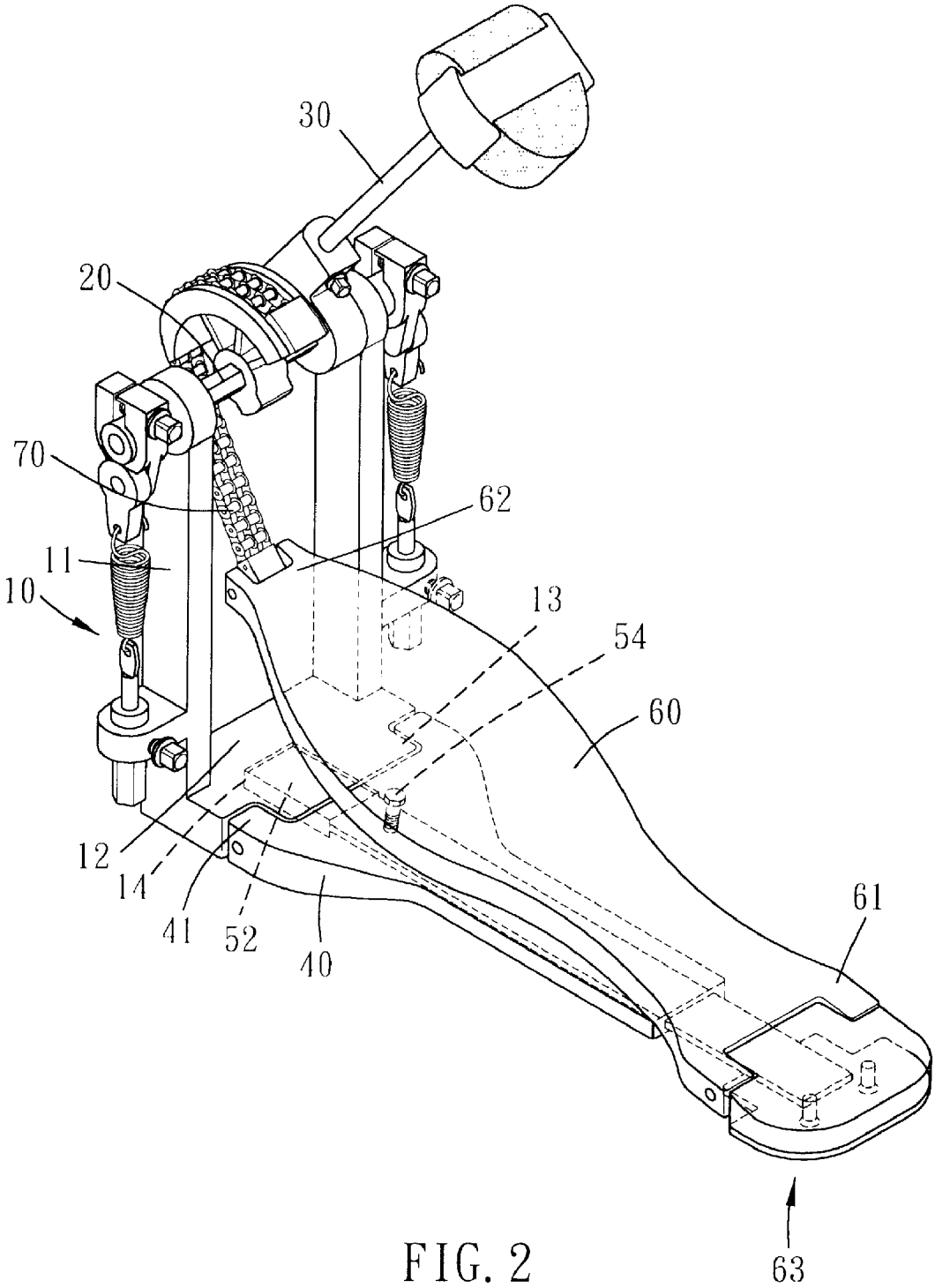
FIG. 2 is a combination drawing showing a first preferred embodiment of the present invention.

Please refer to FIGS. 1 and 2 for a first embodiment of the present invention. A drum pedal assembly includes a frame 10, multiple bearing, an axle 20, a drum hammer 30, a base plate 40, an extender 50, a pedal 60 and a transmission element 70.

The frame 10 includes two parallel upright supportive racks 11 and a base 12. The base 12 connects bottoms of the racks 11, and the base 12 is commonly placed on the ground. In addition, a protrusion 13 is formed on a position of the base 12 where faces the base plate 40, and a slot 14 is disposed on a bottom surface of the base 12. Preferably, the slot 14 is disposed on a bottom surface of the protrusion 13 and has an open end facing the base plate 40.

The bearings are coaxially disposed on the frame 10. In the present embodiment, the bearings include a first hearing and a second bearing respectively disposed on tops of the supportive racks 11. The axle 20 is supported by at least two of the bearings, e.g. the axle 20 is rotatably disposed between the first and second hearings. The drum hammer 30 is disposed on the axle 20 in a rotational operative relationship, i.e. the hammer 30 rotates while the axle 20 rotates. A percussion end of the hammer 30 is used to heat upon a drum skin.

The base plate 40 is pivoted vertically with respect to the base 12 at one end thereof. More specifically, two arm portions 41 are formed on the end of the base plate 40 at the same level. The protrusion 13 locates between the arm portions 41, and the arm portions 41 pivot with respect to the protrusion 13 by pivots 411 respectively, so that the base plate 40 is vertically pivotable with respect to the base. Preferably, a position of the pivot 411 is higher than that of an upper surface of the slot 14. A sliding groove 42 is formed on the base plate 40 along a length direction of the base plate 40. In the present embodiment, the sliding groove 42 has a rectangular cross section and penetrates the base plate 40. Yet the sliding groove 42 may be designed to have a dovetail cross section or the like. The sliding groove 42 has an open end away from the base 12. Preferable, the sliding groove 42 substantially extends along an entire length of the base plate 40 accordingly both ends of the sliding groove 42 are open ends. The position of the sliding groove 42 corresponds to the slot 14.

Figure 3:
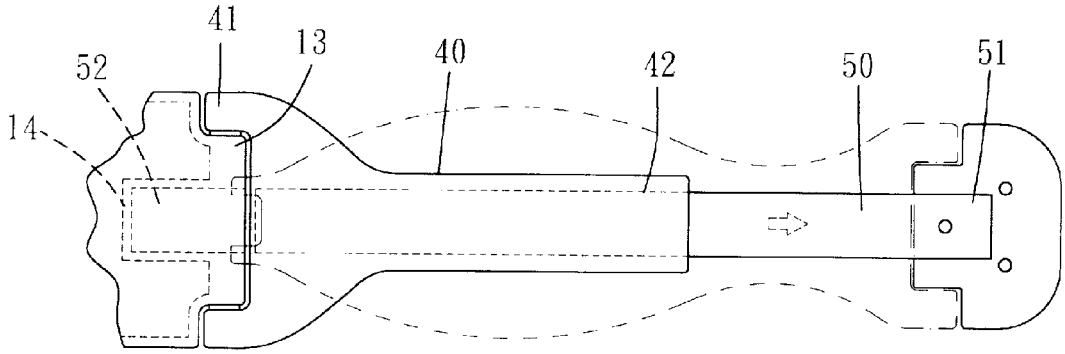
FIG. 3 is a drawing showing an extender sliding away from a base.
Figure 4:
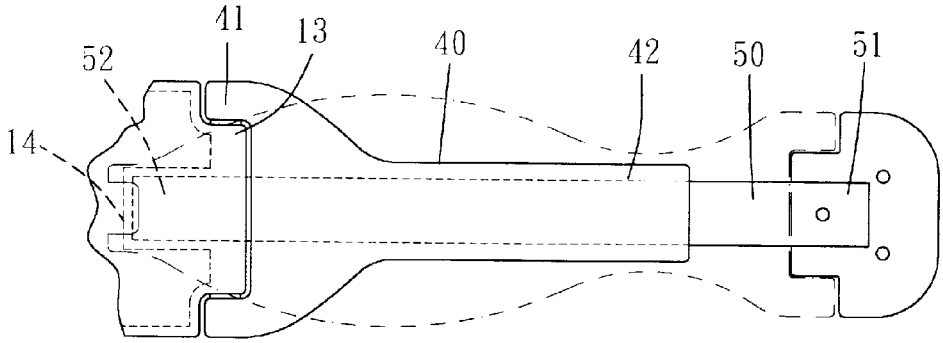
FIG. 4 is a drawing showing an extender sliding toward a base.

Please refer to FIG. 3. The extender 50 is substantially plate-shaped and slidably inserted in the sliding groove 42. Thus, the extender 50 is pivotable about the base 12 along with the base plate 40. Specifically, the extender 50 has a length longer than the sliding groove 42. The extender 50 has a distal end 51 and an insert end 52. The distal end 51 is supposed to extend out of the sliding groove 42 all the time, and the insert end 52 is selectively inserted in the slot 14. As shown in FIG. 4, the base plate 40 is unpivotable about the base 12 when the insert end 42 inserts in the slot 14, thus the base plate 40 substantially perpendiculars to the supportive racks 11. To prohibit the inadvertent movement of the extender 50 during performance, the base plate 40 has a threaded hole 53 communicating with the sliding groove 42 for an abutting screw 54 to engaged therein, such that a bottom end of the abutting screw 54 can abut against the extender 50 while necessary. As such, the extender 50 is positioned by increasing the limiting friction between the extender 50 and the base plate 40.

The pedal 60 has a first end 61 and a second end 62. The first end 61 pivots to the distal end 51 of the extender 50 by a pivot means. In the present embodiment, the pivot means includes a pivoting shank 63 disposed on the distal end 51, and includes a pivot 64 disposed between the pivoting shank 63 and the first end 61 of the pedal 60. Specifically, the pivoting shank 63 includes an upper body 631 and a lower body 632. The distal end 51 is clamped between the upper and lower bodies 631 and 632, and a threaded means or other fasten means is provided to fasten the upper and lower bodies 631 and 632 with each other. The pivot 63 is preferably disposed on the upper body 631. The pivot means, however, may merely includes a pivot that directly pivot the first end 61 of the pedal to the distal end 51 of the extender 50.

The transmission element 70 is disposed between the second end 62 and the axle 20. The transmission element 70 of the present embodiment is a chain. The axle 20 and the hammer 30 can be driven by the transmission element 70 to rotate as the second end 62 of the pedal 60 is treaded to pivot.

Figure 5:
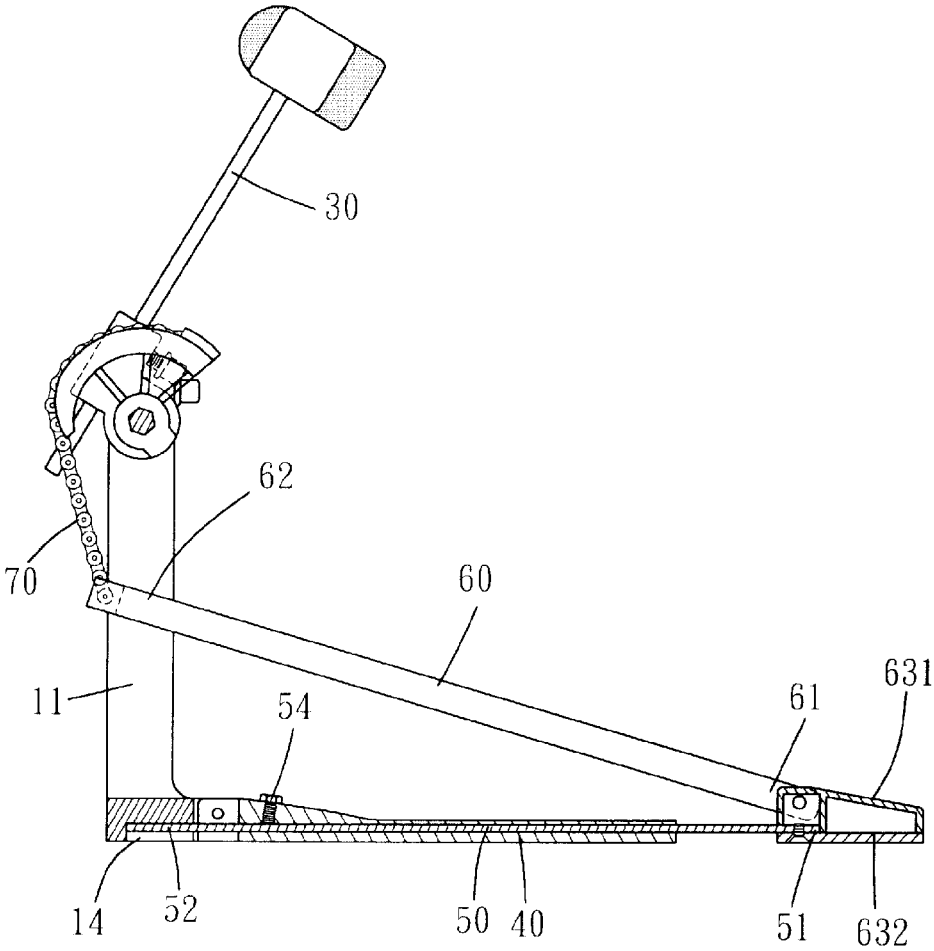
FIG. 5 is a partial profile showing a first embodiment of the present invention.
Figure 6:
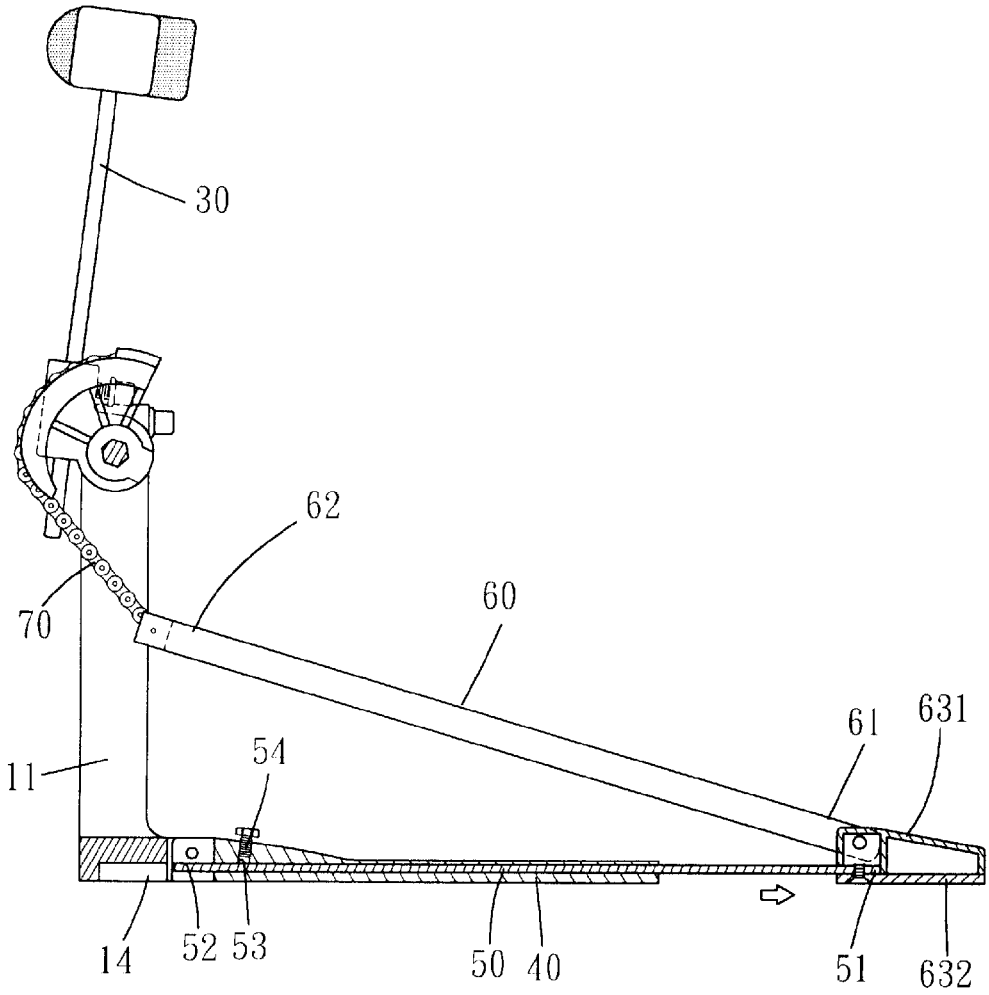
FIG. 6 is a partial profile showing a first embodiment of the present invention.
Figure 7:
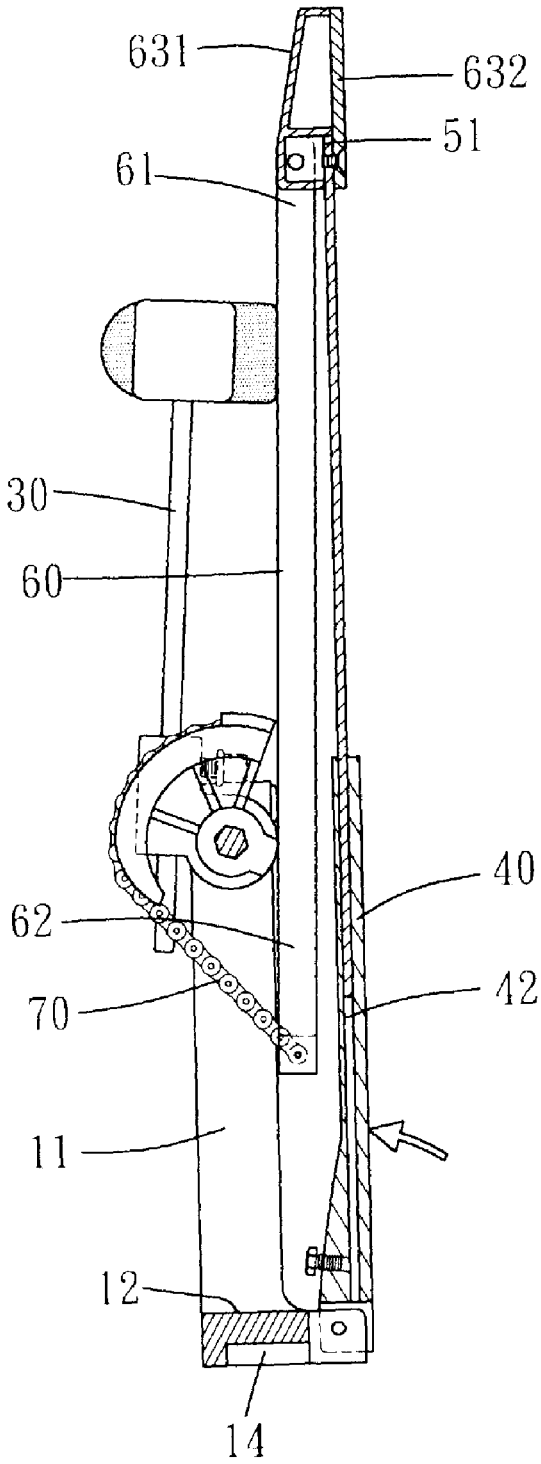
FIG. 7 is a partial profile showing a collapsed first embodiment of the present invention.

As shown in FIGS. 5 and 6, the position of the second end 62 of pedal 60 varies as the extender 50 slides, accordingly the elevation of the hammer 30 is correspondingly adjusted. As shown in FIG. 7, the pedal 60 almost parallels to the base plate 40 and the extender 50 when the pedal assembly is collapsed, i.e. the base plate 40 and the extender 50 pivot toward the supportive racks 11. Due to the extender 50 is still extendable at this time, the elevation of the hammer 30 is therefore adjustable, and preferably the hammer 30 is positioned upright to reduce the space needed to store the pedal assembly.

Figure 8:
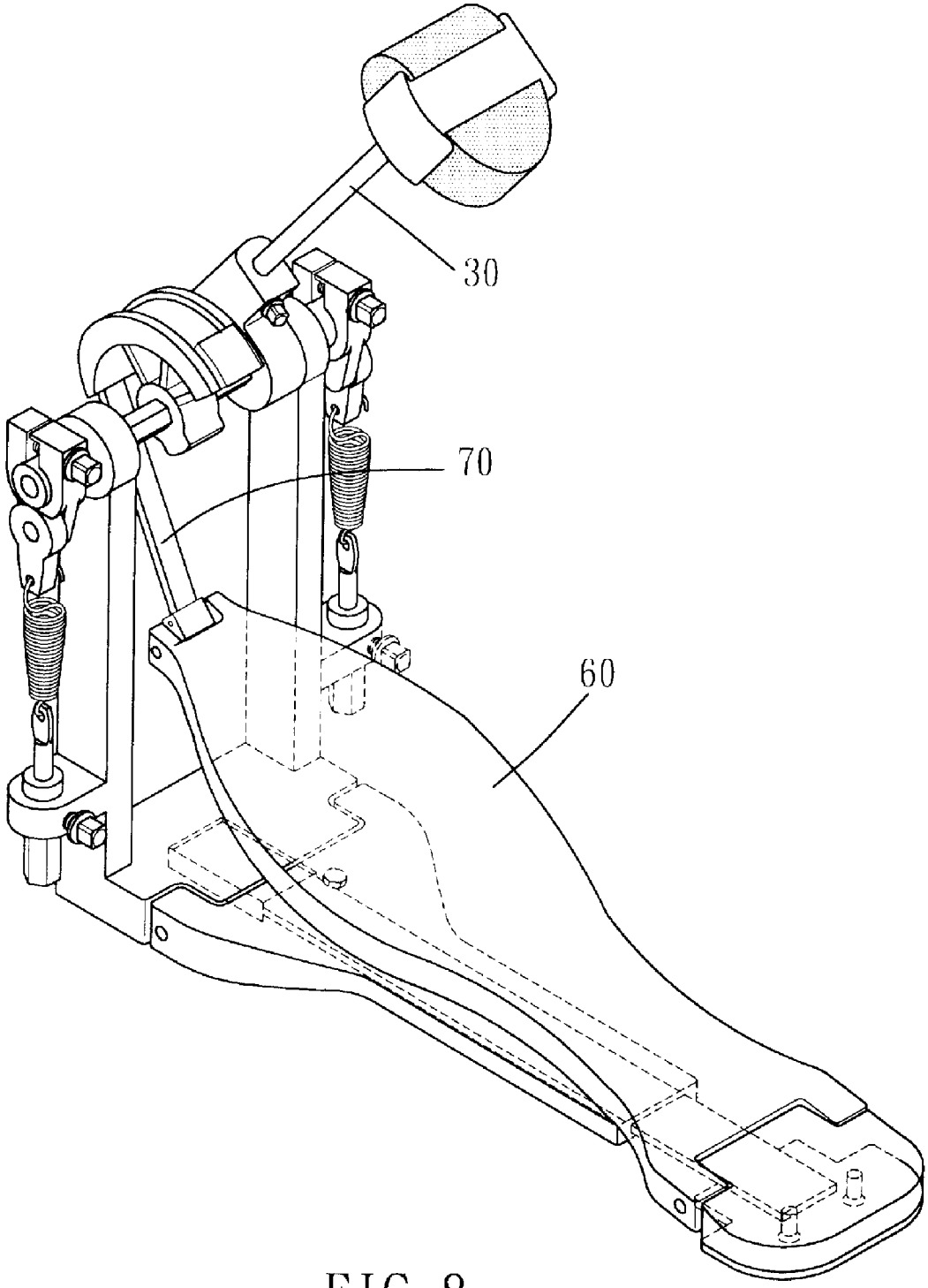
FIG. 8 is a combination drawing showing a second embodiment of the present invention.
Figure 9:
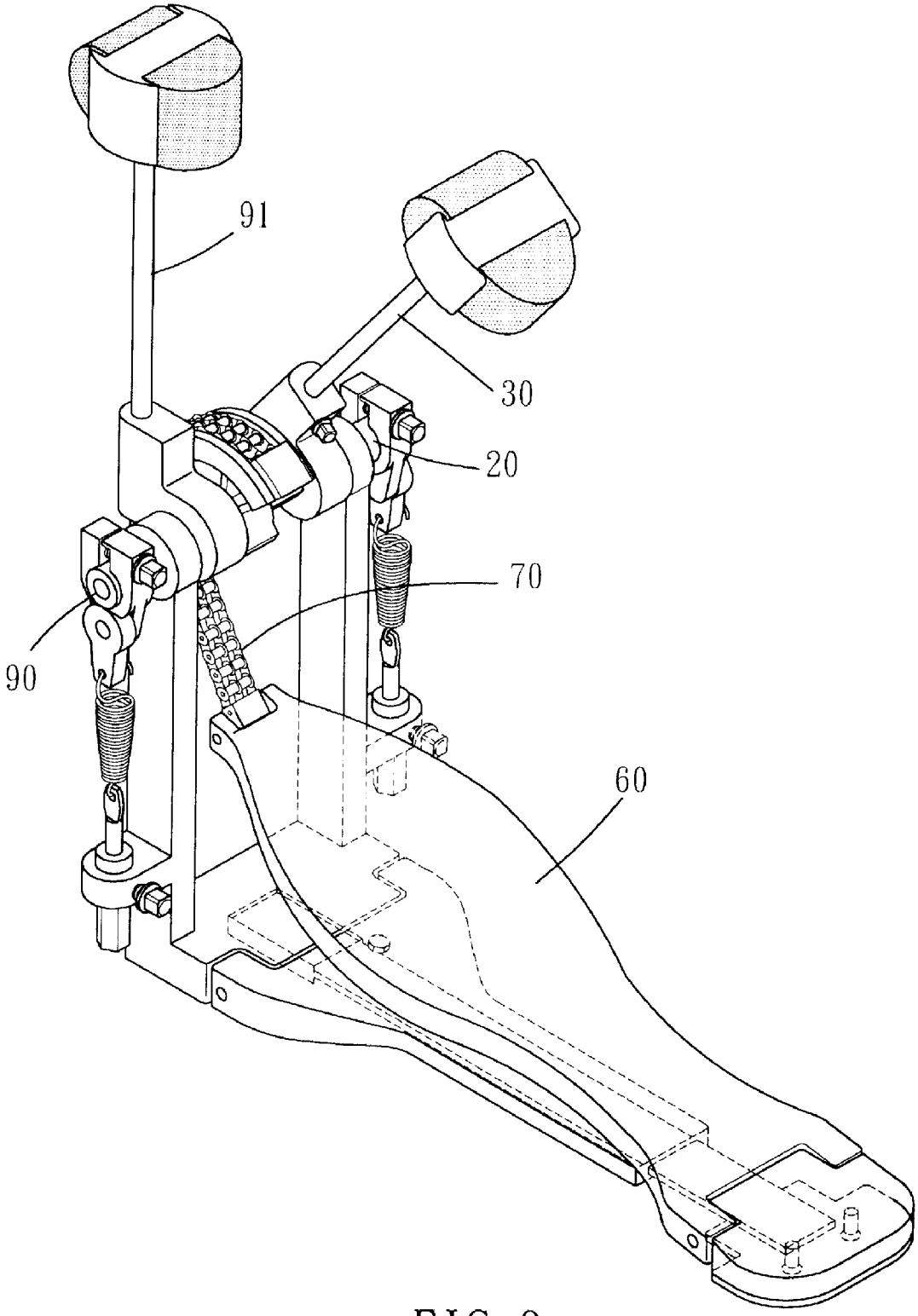
FIG. 9 is a combination drawing showing a third embodiment of the present invention.
Figure 10:
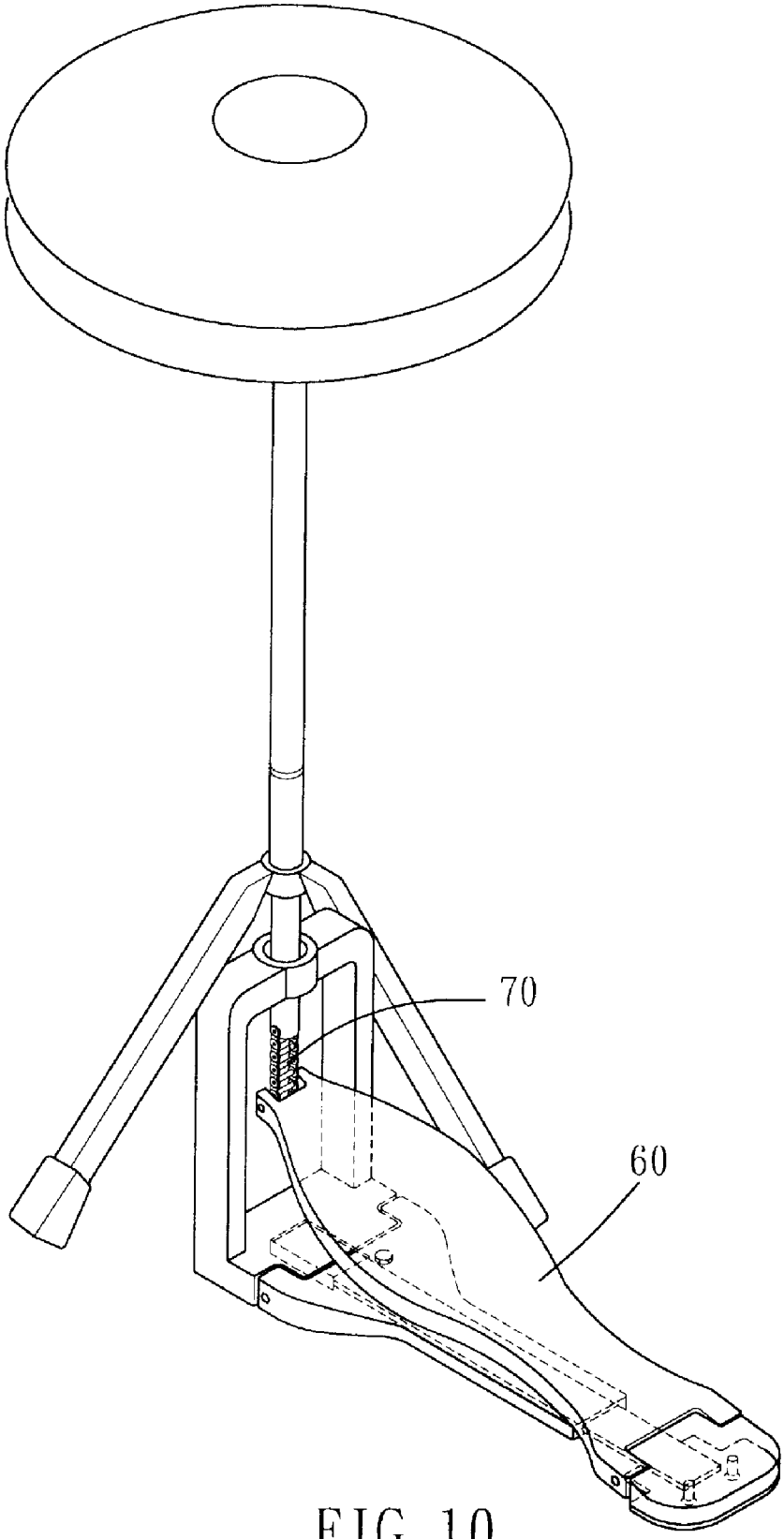
FIG. 10 is a drawing showing a pedal assembly of the present invention being used in another percussion instrument.

Please refer to FIG. 8 for a second embodiment of the present invention. The transmission element 70 may be a belt. Refer to FIG. 9 for a third embodiment of the present invention. The bearings further includes a third hearing (not shown) disposed between the first and second hearings. In this case, the axle 20 is rotatably disposed between the first and third bearings. In addition, the pedal assembly may further include a sub axle 90 and a sub drum hammer 91. The sub axle 90 is rotatably disposed between the second and third hearings, and the sub drum hammer 91 is disposed on the sub axle 90 in a rotational operative relationship. The axle 20 and the sub axle 90 are independently rotatable respectively. That is, the axle 20 is driven by the pedal 60 as discussed hereinabove, and the sub axle 90 is driven by an additional auxiliary device (not shown) such as an auxiliary pedal assembly. The pedal assembly of the present invention may be revised in order to apply on a cymbal instrument, as shown in FIG. 10.

What is claimed is:

1. A drum pedal assembly, comprising:

a frame comprising two parallel upright supportive racks and a the base connecting bottoms of the supportive racks;

multiple bearings; coaxially disposed on the frame;

an axle, supported by at least two of the bearings;

a drum hammer, disposed on the axle in a rotational operative relationship;

a base plate pivoted vertically with respect to the base at one end thereof, a sliding groove having formed on the base plate along a length direction of the base plate, the sliding groove having an open end away from the base;

an extender, being plate-shaped and slidably inserted in the sliding groove, the extender and the base plate being pivotable about the base, the extender having a distal end away from the base;

pedal, having a first end and a second end, the first end pivoting to the distal end of the extender by a pivot means; and a transmission element, disposed between the second end of the pedal and the axle, the axle and the drum hammer being driven by the transmission element to rotate as the second end of the pedal pivots;

wherein the sliding groove substantially extends along an entire length of the base plate, and a length of the extender is longer than that of the sliding groove;

wherein a slot is disposed on a bottom surface of the base, the slot has an open end facing the base plate for an inserting end of the extender to selectively insert therein, the base plate substantially perpendiculars to the supportive racks and is unpivotable about the base as the inserting end inserts in the slot.

2. The drum pedal assembly of claim 1, wherein two arm portions are formed apart on the end of the base plate at a same level, a protrusion is formed on the base and located between the arm portions, the arm portions pivot with respect to the protrusion respectively, and the slot is disposed on a bottom surface of the protrusion.

3. The drum pedal assembly of claim 2, wherein each arm portion pivots with respect to the protrusion by a pivot, a position of the pivot is higher than that of an upper surface of the slot.

4. The drum pedal assembly of claim 1, wherein the pivot means comprises a pivoting shank disposed on the distal end of the extender, the pivot means further comprises a pivot disposed between the pivoting shank and the first end of the pedal.

5. The drum pedal assembly of claim 4, wherein the pivoting shank comprises an upper body and a lower body, the distal end of the extender is clamped between the upper and lower bodies, and the pivot is disposed on the upper body.

6. The drum pedal assembly of claim 1, wherein the bearings comprise a first bearing and a second bearing respectively disposed on tops of the supportive racks, the axle is rotatably disposed between the first and second bearings.

7. The drum pedal assembly of claim 1, wherein the bearings comprise a first bearing and a second bearing respectively disposed on tops of the supportive racks, and the bearings further comprise a third bearing disposed between the first and second bearings, the axle is rotatably disposed between the first and third bearings; a sub axle, rotatably disposed between the second and third bearings; a sub drum hammer, disposed on the sub axle in a rotational operative relationship; wherein the axle and the sub axle are independently rotatable respectively.

8. The drum pedal assembly of claim 1, wherein the transmission element is a chain or a belt.

9. The drum pedal assembly of claim 1, wherein the base plate has a threaded hole communicating with the sliding groove for an abutting screw to engaged therein, such that a bottom end of the abutting screw selectively abuts against the extender.

* * * * *